US006741215B2

(12) United States Patent
Grant et al.

(10) Patent No.: US 6,741,215 B2
(45) Date of Patent: May 25, 2004

(54) INVERTED SAFETY ANTENNA FOR PERSONAL COMMUNICATION DEVICES

(76) Inventors: Jerry Allen Grant, P.O. Box 662, Hemingway, SC (US) 29554; Gary Dean Ragner, 711 SW. 75th St., #103, Gainesville, FL (US) 32607; James Garfield Geesey, 336 Barmount Dr., Columbia, SC (US) 29210

( * ) Notice: Subject to any disclaimer, the term of this patent is extended or adjusted under 35 U.S.C. 154(b) by 0 days.

(21) Appl. No.: 10/207,691

(22) Filed: Jul. 29, 2002

(65) Prior Publication Data

US 2003/0160726 A1 Aug. 28, 2003

Related U.S. Application Data

(60) Provisional application No. 60/309,062, filed on Jul. 31, 2001.

(51) Int. Cl.[7] ..... H01Q 1/24
(52) U.S. Cl. ..... 343/702
(58) Field of Search ..... 343/702, 841; 455/90, 550

(56) References Cited

U.S. PATENT DOCUMENTS

| | | | | |
|---|---|---|---|---|
| 4,571,595 A | | 2/1986 | Phillips | |
| 5,014,346 A | | 5/1991 | Phillips | |
| 5,170,173 A | | 12/1992 | Krenz | |
| 5,262,792 A | | 11/1993 | Egashira | |
| 5,337,061 A | | 8/1994 | Pye | |
| 5,508,709 A | | 4/1996 | Krenz | |
| 5,561,436 A | | 10/1996 | Phillips | |
| 5,561,437 A | | 10/1996 | Phillips | |
| 6,025,804 A | * | 2/2000 | Davis et al. | 343/702 |
| 6,028,556 A | * | 2/2000 | Shiraki | 343/702 |
| 6,104,350 A | | 8/2000 | Ng | |
| 6,184,835 B1 | | 2/2001 | Chen | |
| 6,215,447 B1 | | 4/2001 | Johnson | |
| 6,246,374 B1 | | 6/2001 | Perrotta | |
| 2002/0025827 A1 | * | 2/2002 | Song | 455/550 |

FOREIGN PATENT DOCUMENTS

| | | |
|---|---|---|
| WO | WO-0193611 | 12/2001 |

* cited by examiner

*Primary Examiner*—Hoang Nguyen

(57) ABSTRACT

This invention provides a novel geometry for the placement of components on a personal wireless communication device (150) to greatly reduce the radiation impinging on a user's head and brain. Radiation intensity experienced by a user's brain is reduced by placing transmitting antenna (152) on the bottom of communication device (150) and having the housing of communication device (150) form an obtuse angle so that the bottom portion of the housing angles away from the user's face. Speaker outlet earpiece (158) is placed near the top of upper housing (160) to keep the user's ear, head, and brain away from antenna (152) which is placed on the bottom of lower housing (164). Control keypad (165), display (163), and microphone (166) are placed below earpiece (158) as space allows on communication device (150). The design may include a pivot joint between upper housing (160) and lower housing (164) to provide the obtuse angled section between earpiece (158) and antenna (152) and thus, angle the lower housing of communication device (150) away from the operator's face while in use.

18 Claims, 12 Drawing Sheets

Figure 2A:
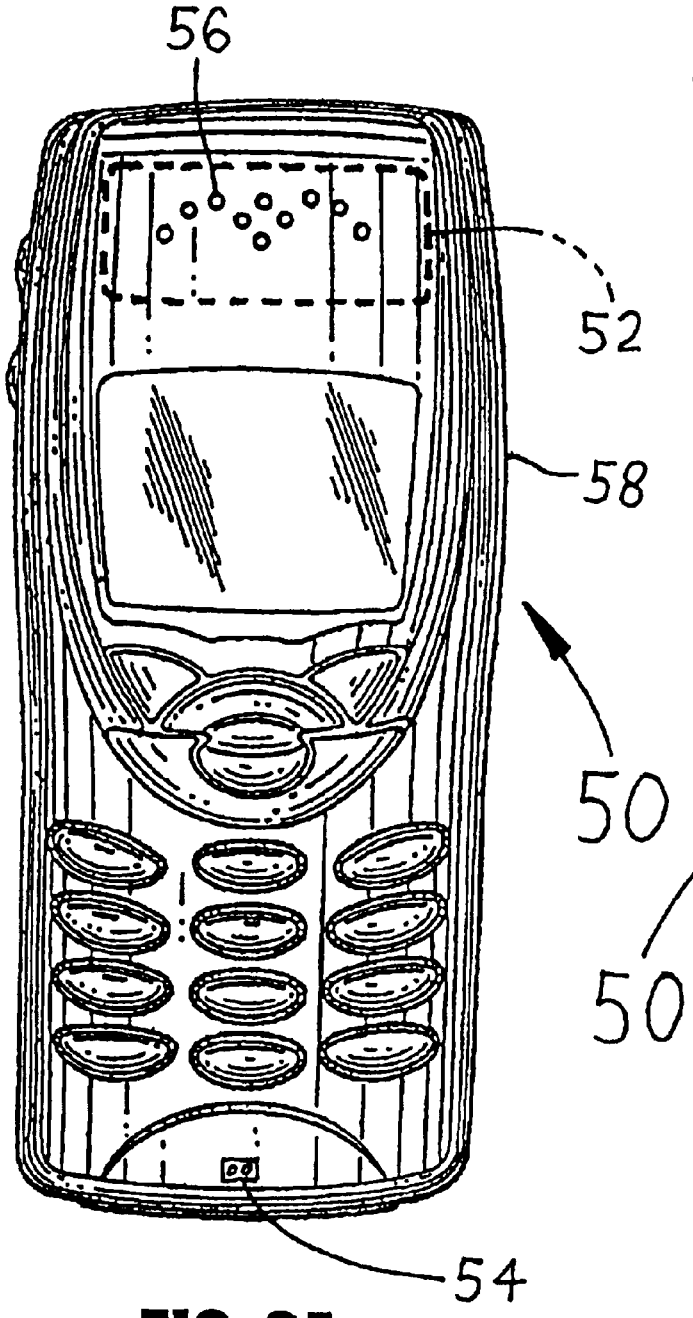
FIG. 2A PRIOR ART

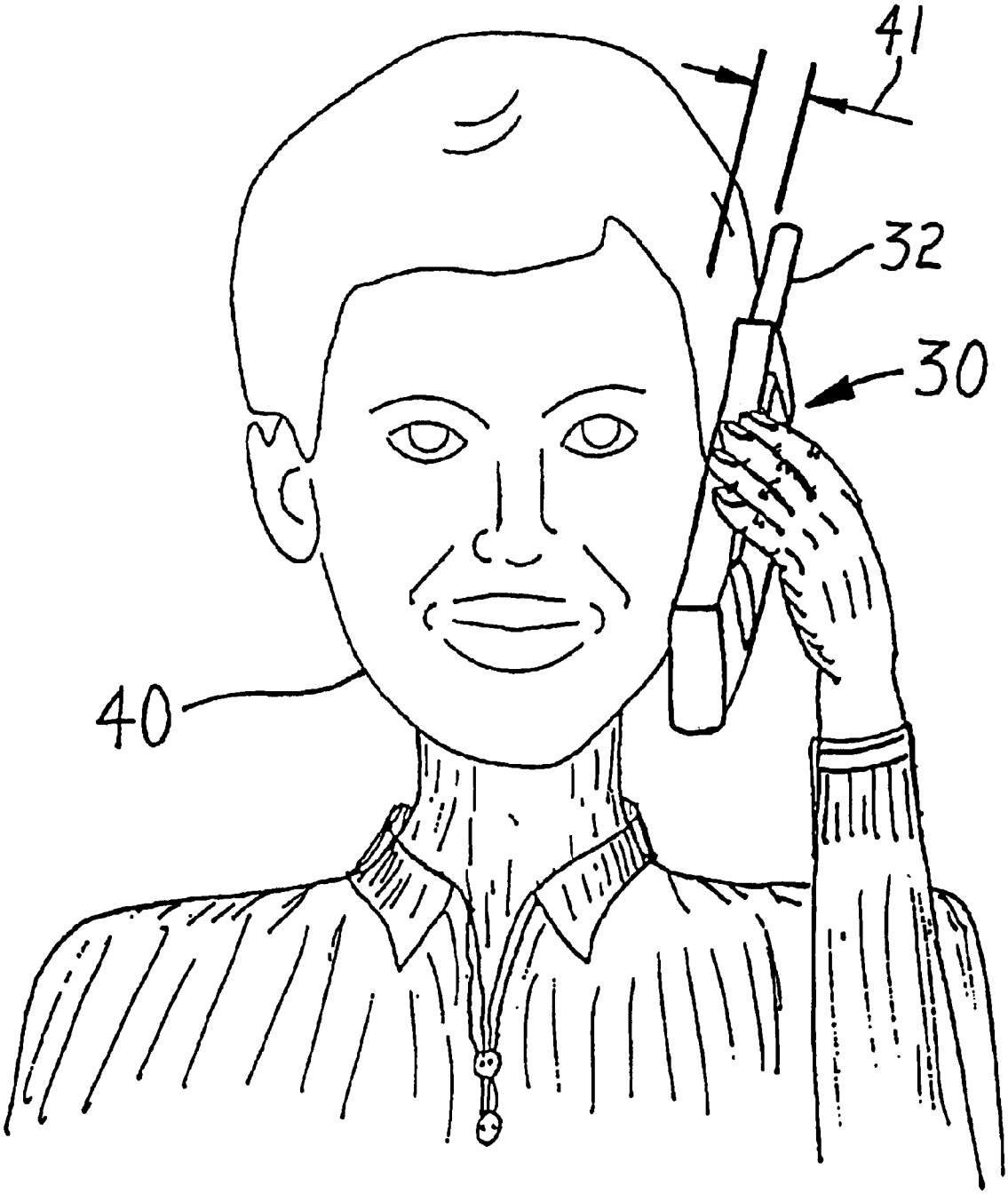
FIG. 1 – PRIOR ART

INVERTED SAFETY ANTENNA FOR PERSONAL COMMUNICATION DEVICES

CROSS-REFERENCE TO RELATED APPLICATIONS

This utility application claims priority from U.S. Provisional Application Ser. No. 60/309,062 filed on Jul. 31, 2001.

BACKGROUND

This invention relates to personal wireless communications devices, and more specifically to communications device designs that reduce the radiation received by the user.

DESCRIPTION OF PRIOR ART

The use of cellular phones and other wireless communication devices have become very popular in recent years. (PDA's phones, cellular phone, walkie-talkies, digital communicators, wireless phones, and others are among the many ways we communicate. Along with these phones has come the fear that they may cause health problems, including cancer. Whether this fear is founded or just hysteria, science has yet to determined conclusively. However, the fact remains that the majority of people presently want devices that limit their exposure to electromagnetic radiation emitted by these communication devices. And the Environmental Protection Agency has taken the threat seriously enough to fund expensive long-term research in this area and has issued cautionary warnings about the extended use of cellular phones. The problem is particularly great with modern cellular phones and other high power wireless communication devices which use the new very short antennas. These short antennas produce a much higher power density around the antenna compared to older long antennas. When in use, these personal communication devices are brought to rest against the user's ear and the antenna is positioned approximately one inch away from the user's head with their brain absorbing a considerable portion of the antenna radiation. People's biggest fear is that very this close proximity of a high-power antenna to the user's skull can cause brain cancer and leukemia. Besides the possible problem with cancer, placing a person's head so close to the antenna also causes a significant portion of the transmitted energy to be absorbed or blocked. This reduces the transmitted signal and can cause communication problems due to a weakened signal.

Inventors have attempted to solve the radiation absorption problem by designing a multitude of ways to block and shield the transmitted signal from the user's head. Unfortunately, these designs still create very strong radiation patterns near the user's head, and also interfere with transmission and reception of signals. Many companies have compromised by simply moving the location of the antenna a few millimeters further away from the user's head. Angling the antenna slightly away from the user's head is also a common practice.

However, prior art does exist which may reduce radiation exposure for the user, including:

Foreign Patent WO0193611 published Dec. 6, 2001 to Harris of Australia

U.S. Pat. No. 6,246,374 on Jun. 12, 2001 to Perrotta

U.S. Pat. No. 6,184,835 on Feb. 6, 2001 to Chen

U.S. Pat. No. 6,104,350 on Aug. 15, 2000 to Ng

U.S. Pat. No. 5,561,437 on Oct. 1, 1996 to Phillips

U.S. Pat. No. 5,508,709 on Apr. 16, 1996 to Krenz

U.S. Pat. No. 5,337,061 on Aug. 9, 1994 to Pye

U.S. Pat. No. 5,170,173 on Dec. 8, 1992 to Krenz

U.S. Pat. No. 5,014,346 on May 7, 1991 to Phillips

U.S. Pat. No. 4,571,595 on Feb. 18, 1986 to Phillips

None of the prior art appears to show the Applicants' designs. The Applicants' invention can provide radiation intensities to the user's brain nearly an order of magnitude lower than any of the above prior art. The Applicants' design may also provide better reception at the same power level than prior art because of reduced signal absorbed by the user's head and face. The physical distance placed between the user and the transmitting antenna accomplishes this. Mounting the antenna on the bottom achieves this distance (see FIG. 3). Angling the antenna at the bottom of the phone can further increases the distance (see FIGS. 8 and 10), and combining a bottom mounted antenna with an angle-away body section (see FIGS. 4, 6, 7 and 12) can further reduce the radiation intensity absorbed by the user over the best prior art.

SUMMARY

The disclosed invention solves the radiation problem for wireless communication devices by placing the transmitting antenna on the bottom of the communication device. Radiation levels can be further reduced by angling the transmitting antenna on the bottom of the communication device so that it angles away from the user's face while in use. The phone housing may also be angled so that the bottom portion of the phone is positioned away from the user's head and brain, which effectively positions the transmitting antenna significantly away from the user's head and brain. The result is that the user absorbs less total energy, and the highest intensity electromagnetic radiation ("hot spot") next to the brain can be eliminated. This repositioning of the antenna places the antenna at about chin and neck level on the user depending on how they hold the phone. This has the secondary advantage that it allows more horizontally transmitted signal to escape absorption. Absorption is reduced both because of the thinner effective cross-section of the user's chin and neck area, and the greater distance the antenna is away from the user's chin and neck. Also, if a directional transmitting antenna can be used (see FIG. 7B) the user can absorb even less of the electromagnetic radiation. The result is a much smaller percentage of the transmitted and received electromagnetic radiation can be absorbed by the user, thus improving both transmission and reception of electromagnetic signals.

Objectives and Advantages

Figure 4:
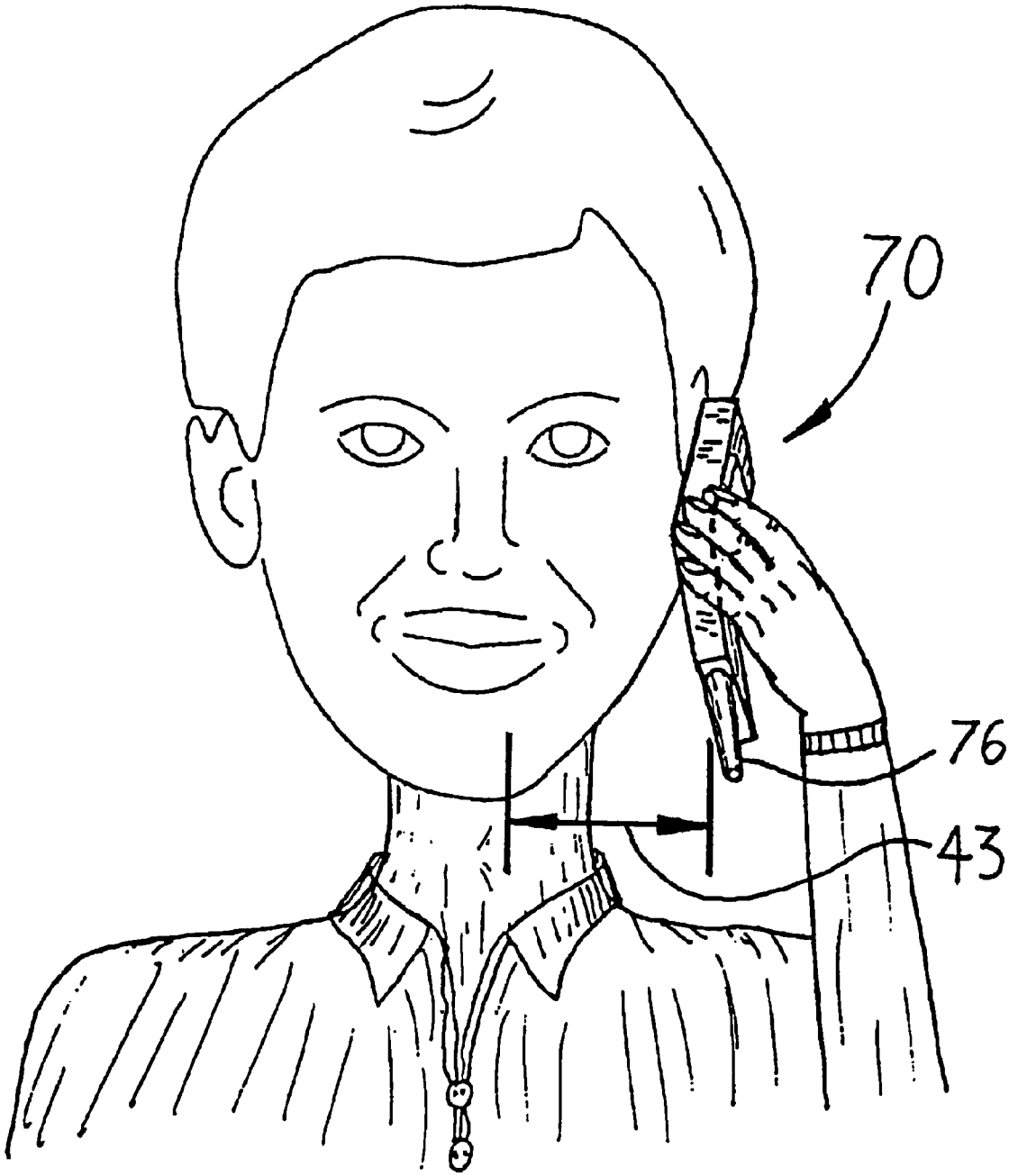
Figures 6, 6A:
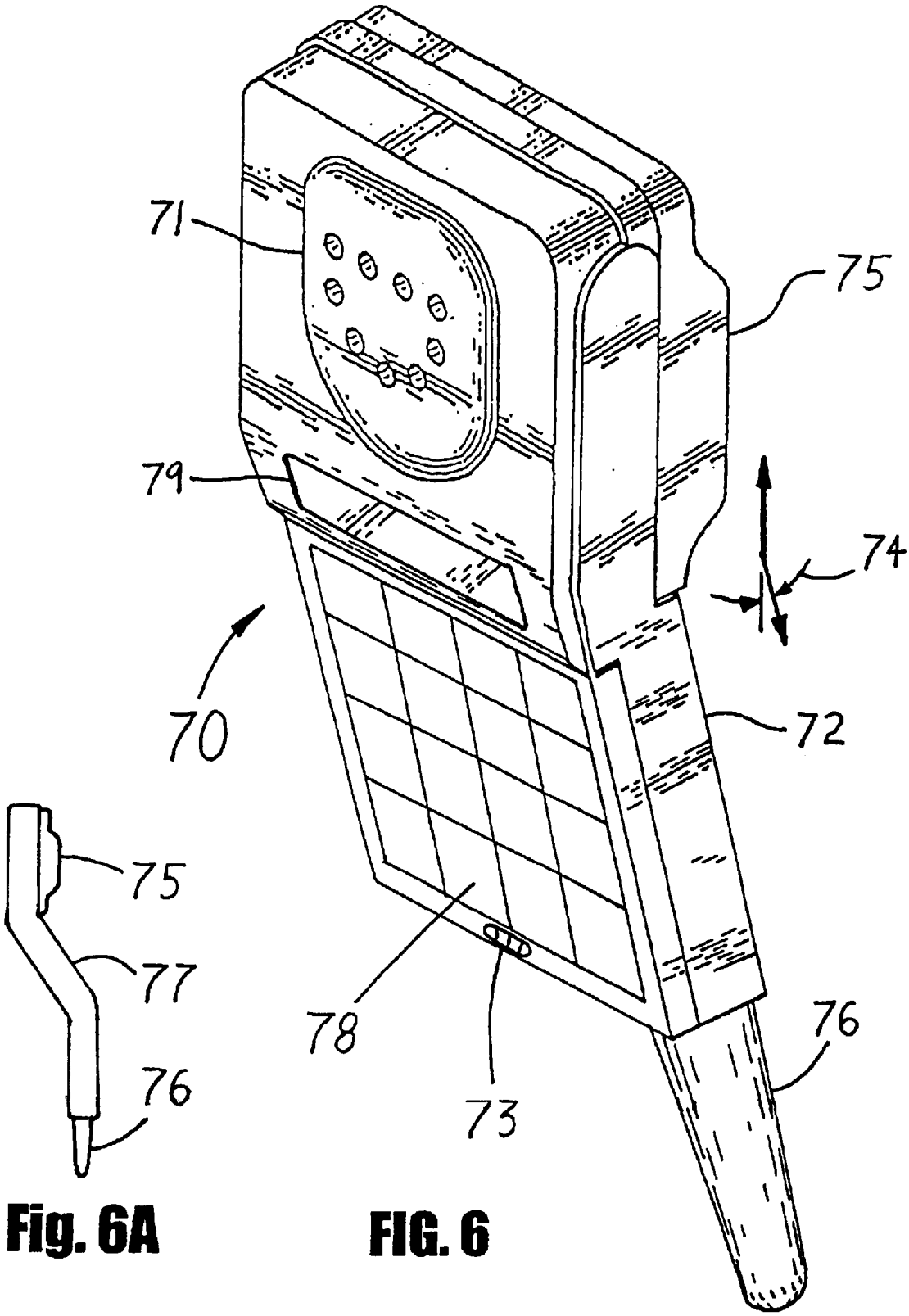
Figures 7A, 7B:
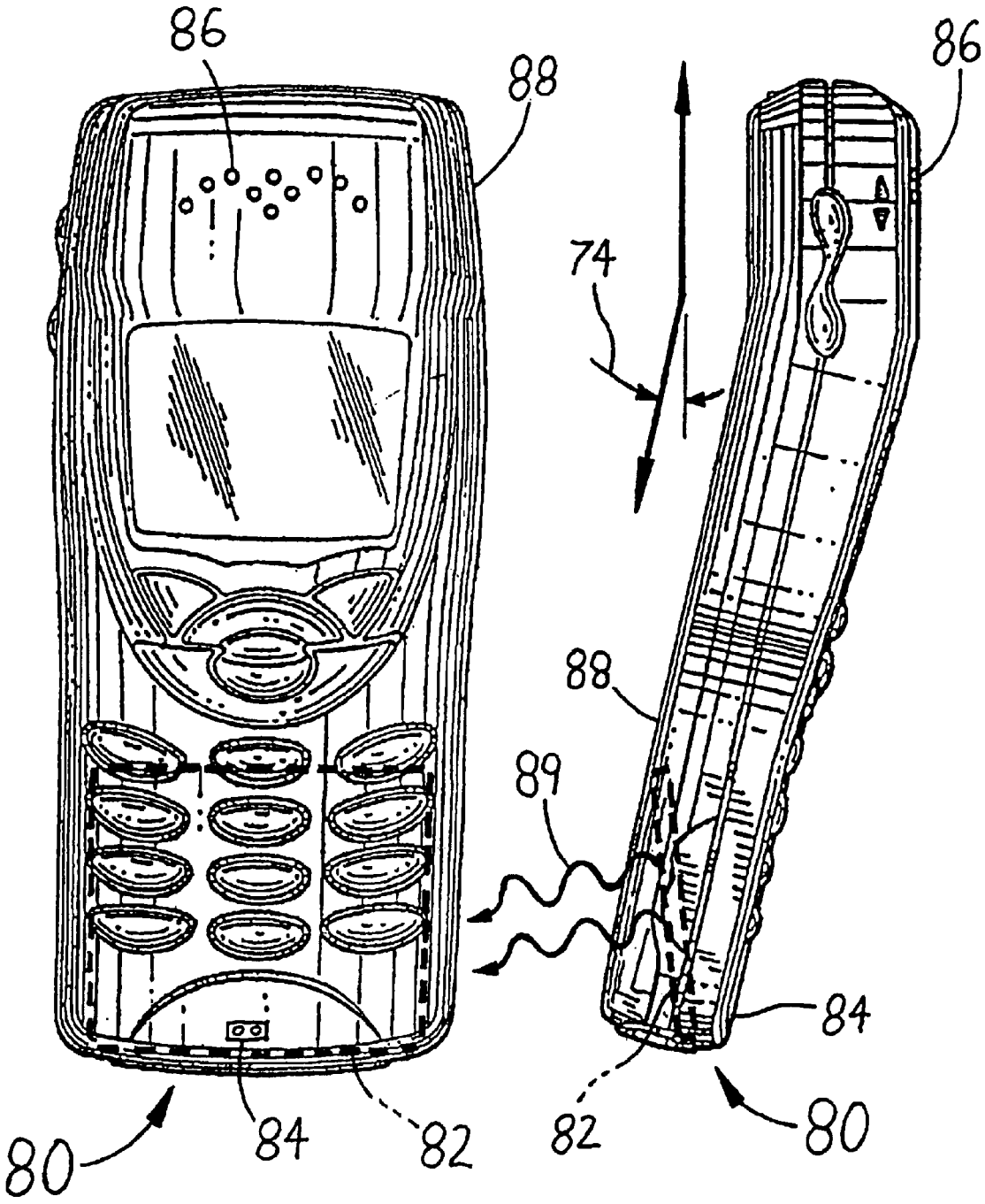
Figure 8:
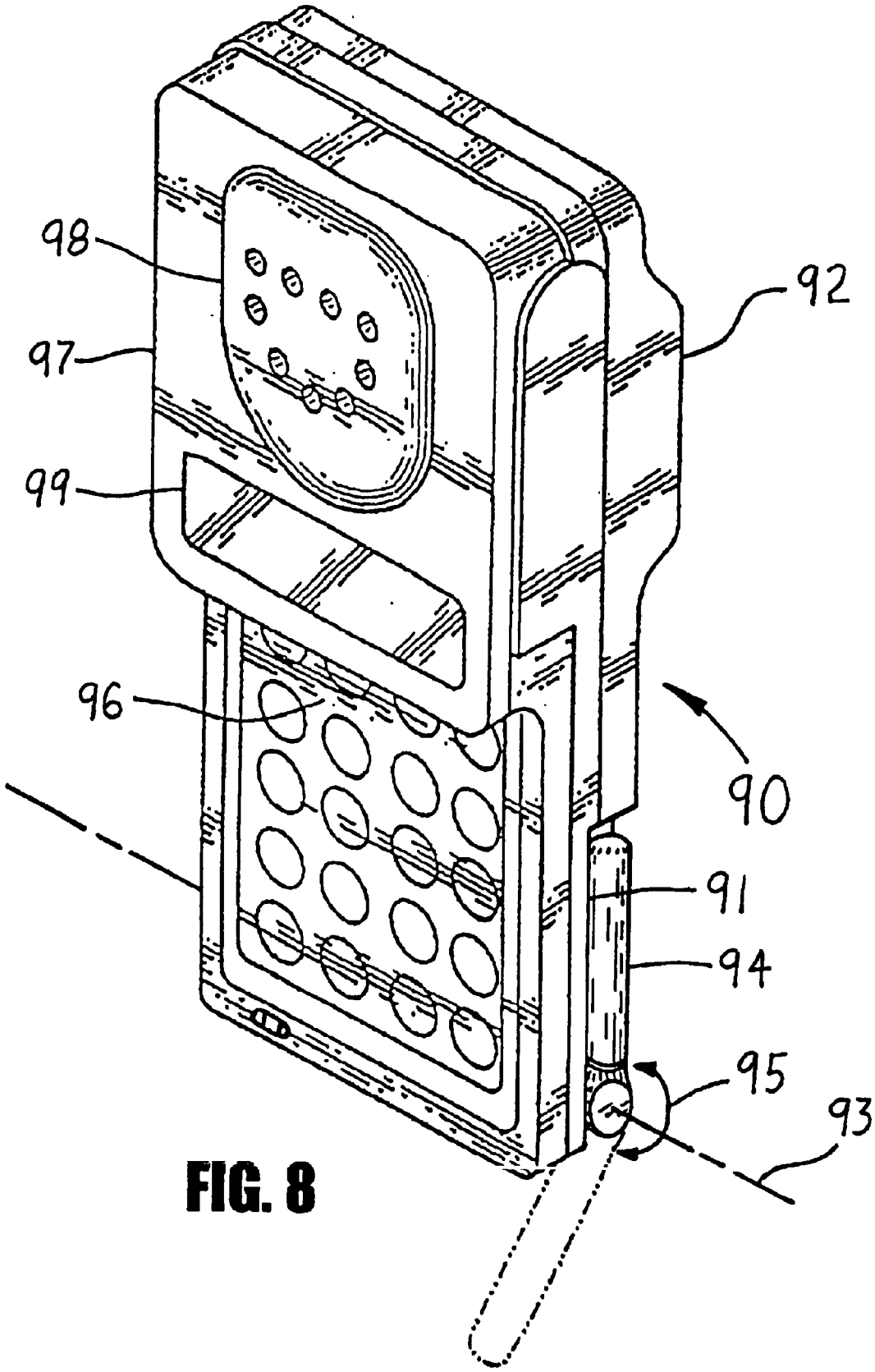
Figure 12A:
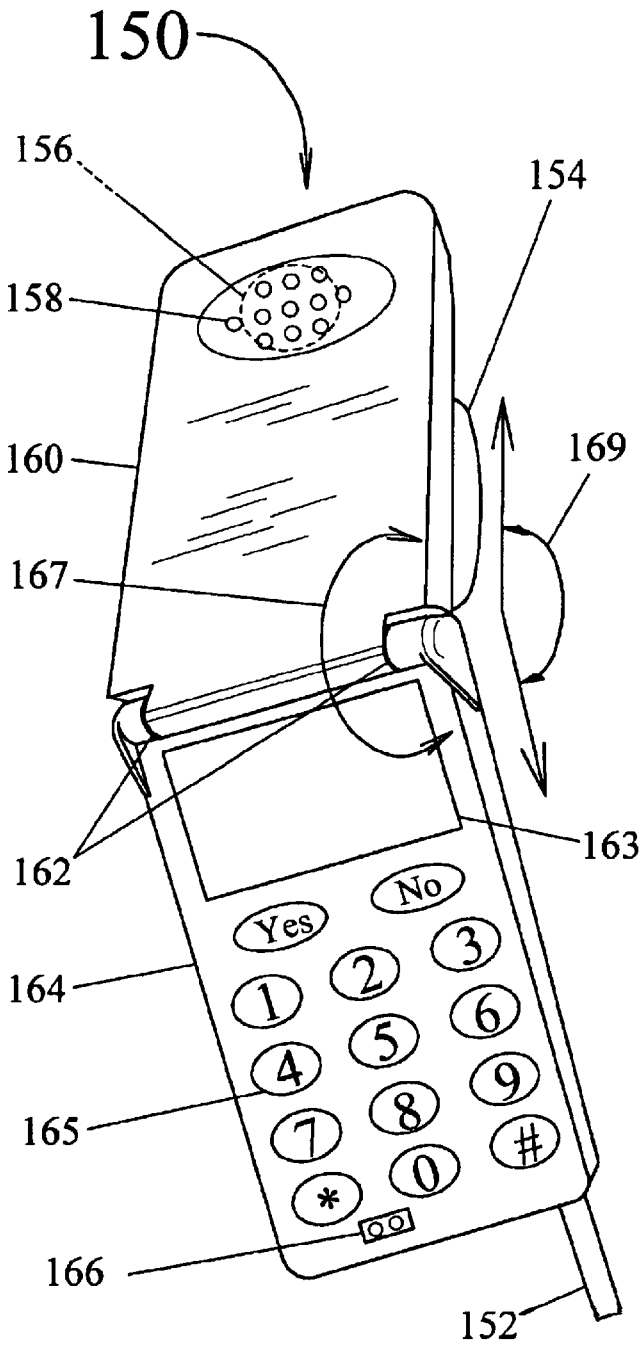

Accordingly, the disclosed invention can have one or more of the following objects and/or advantages:

a) To allow a cellular phone antenna to be moved significantly away from the user's head and brain, thereby greatly reducing the potential damage done by electromagnetic waves.

b) To provide antenna transmission at approximately chin or neck level, to improve horizontal transmission field due to the thinner cross-section of the user's chin area and neck (less absorption) compared to placing the antenna near the user's head.

c) To provide a directional antenna in the bottom portion of a phone to further reduce radiation absorbed by the user's head.

d) To use lower transmitter power settings because of the better horizontal transmission field mentioned in item "b)" and "c)" above.

e) To greatly reduce total radiation absorbed by a user's brain and head when using a wireless communication device.

f) To greatly reduce the electromagnetic energy intensity (power density-watts/cm^3) experienced by the user's brain.

g) To locate the normal operating position for a wireless communication antenna a significant distance away from the user's head without significantly changing the general ergonomics of the wireless device.

h) To greatly reduce radiation absorption from wireless communication devices, and reduce the need for radiation shields or remote earphones and microphones.

i) To allow the user to adjust the angle of the antenna for better reception while at the same time reducing the user's exposure to high-intensity antenna radiation.

j) To allow the ear piece portion of the wireless device to be at an angle with respect to the majority of the device so that the body of the phone angles far away from the operator when used (FIGS. 7A & B). With the antenna on the bottom of the phone the radiation pattern can be placed further away from the user's face than with phones which may be angled near their mid-section (FIGS. 4 and 6).

k) To allow lower radiation levels by mounting an antenna on the lower back portion of the wireless communication device (see FIGS. 7A, 7B and 8).

l) To allow standard antenna designs and transmitters to be used with the new invention without the need for major modifications, thereby reducing the cost of modifications to the phone.

m) To provide a bottom mounted antenna that is pivotal along one and/or two axis.

n) To allow much higher transmitter power levels while maintaining safe radiation levels to the user's brain by operating the antenna a significant distance away from the user's head.

o) To provide a flip-open phone where the antenna is in the lower portion of the phone and the phone opens to angle backward away from the user's face when in use.

p) To provide a flip-phone design which opens to more than 180 degrees (see FIGS. 9, and 12A & B) and has the battery and speaker in the top portion of the phone.

q) To provide a flip-phone design which opens to more than 180 degrees and has the keypad and antenna in the bottom (lower) portion of the phone (see FIGS. 12A&B).

r) To provide a flip-phone that can be designed to be gripped by the upper portion of the phone so that the user's hand and fingers are exposed to lower levels of electromagnetic radiation from the transmitting antenna on the lower portion.

s) To provide a flip-phone that can be designed to easily be gripped by the upper portion of the phone and not easily gripped by the lower portion of the phone to encourage the user to keep their hand and fingers away from the transmitting antenna on the lower portion. This both reduces absorbed radiation, and improves transmission and reception of electromagnetic signals.

DRAWING FIGURES

FIG. 1 Prior Art—wireless communications device in normal use.

FIG. 2A Prior Art wireless communications device with antenna enclosed within housing.

Figure 2B:
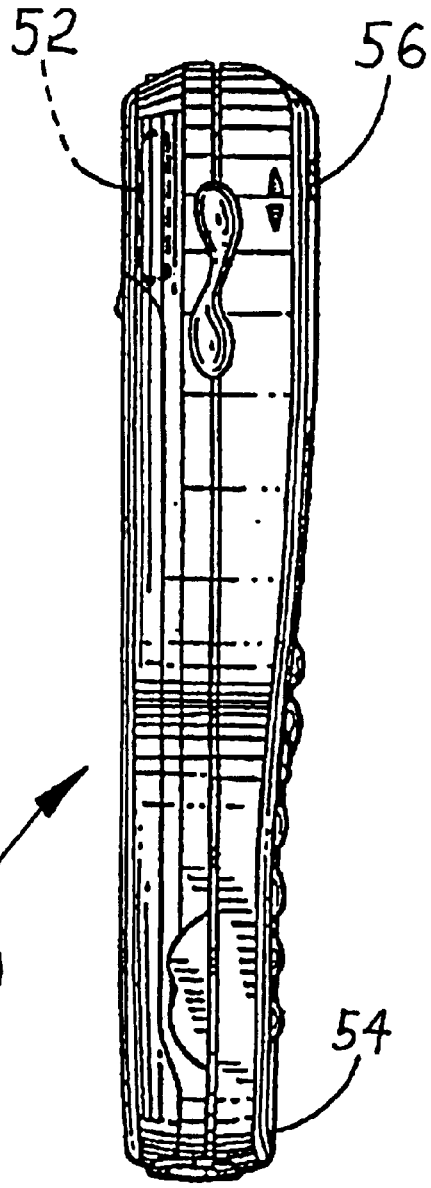
FIG. 2B PRIOR ART

FIG. 2B Prior Art wireless communications device in FIG. 2A (side-view).

Figure 3:
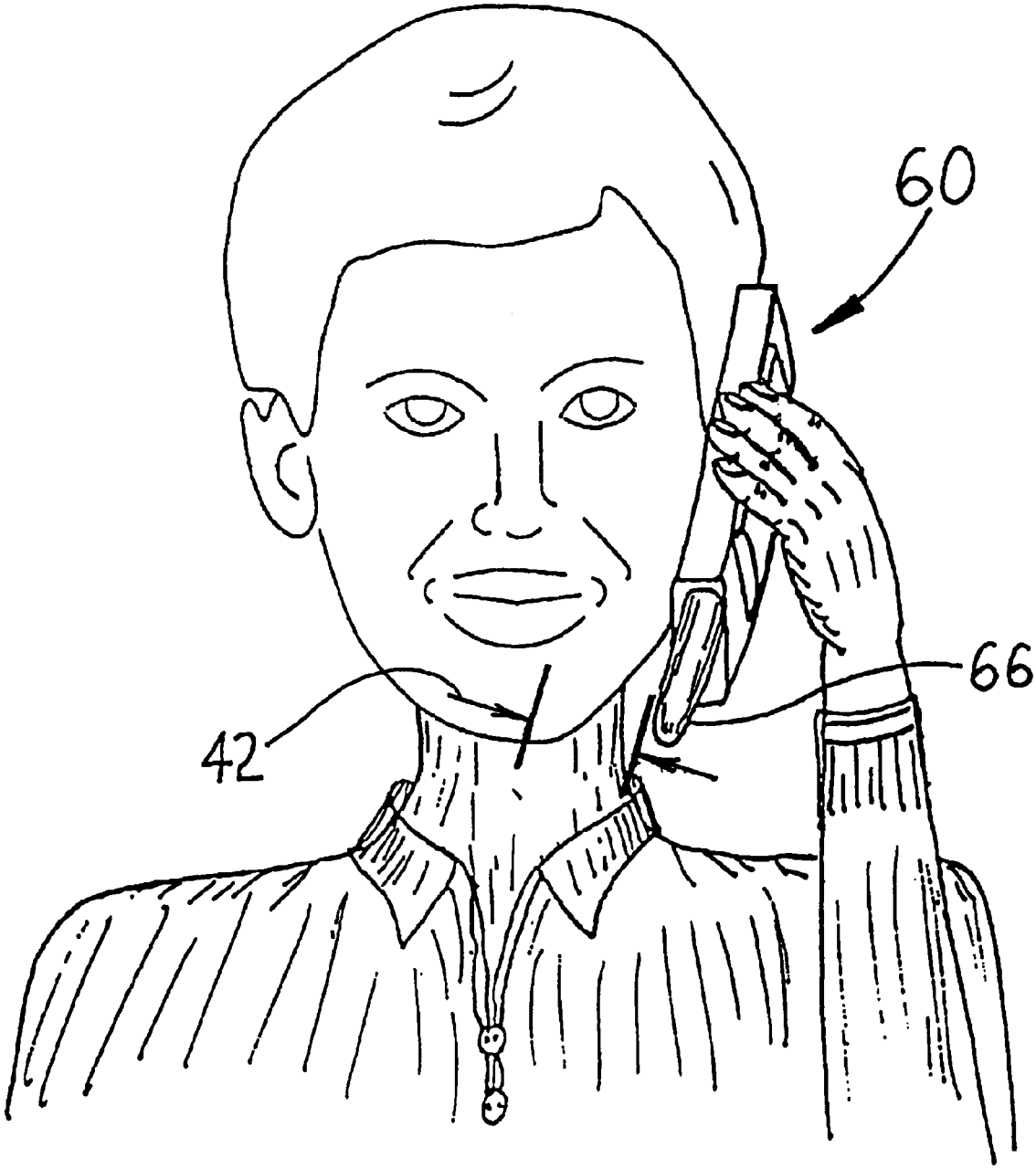

FIG. 3 Inverted wireless communication device being used.

FIG. 4 Angled body phone design being used.

Figure 5:
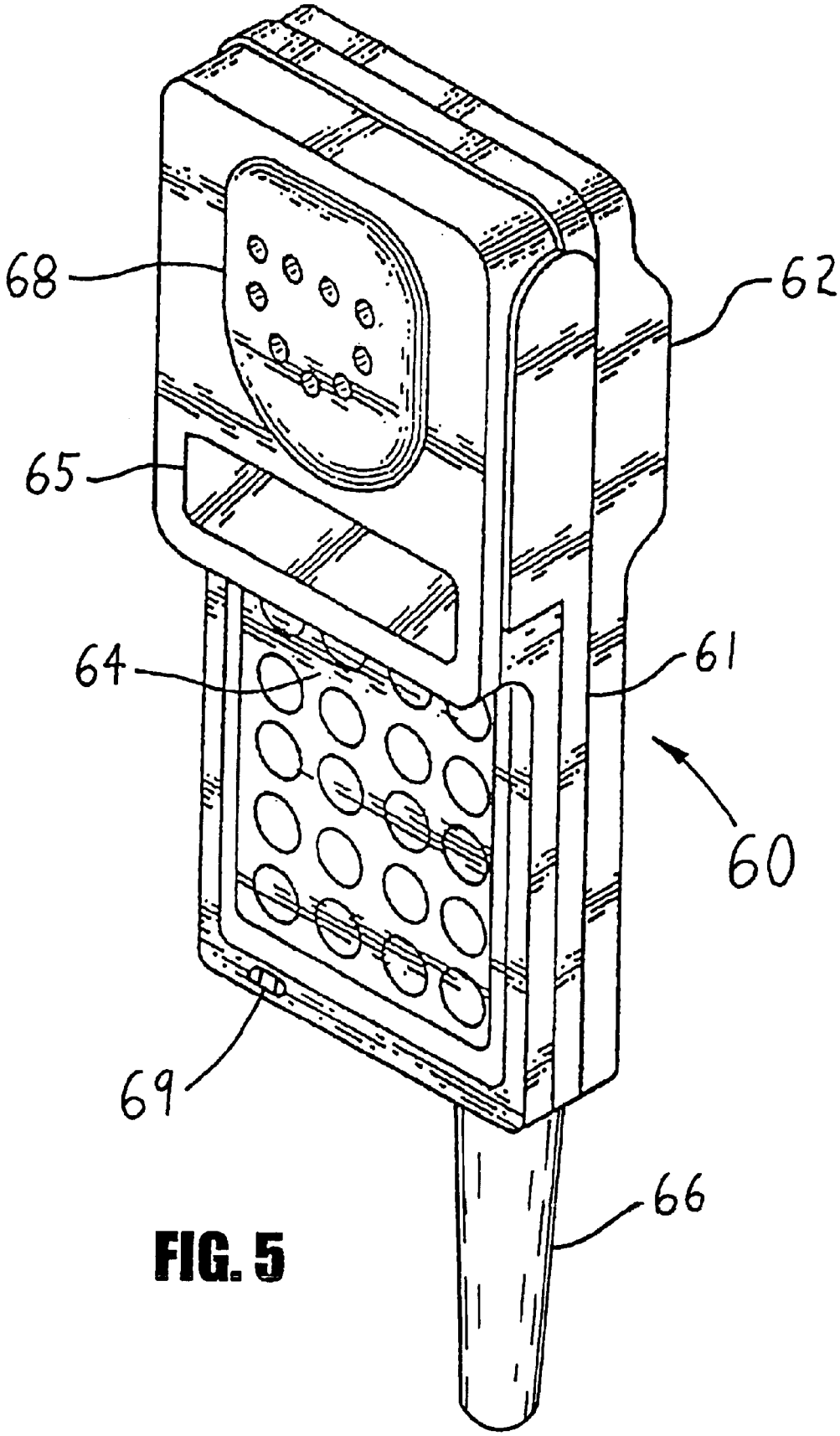

FIG. 5 Phone with inverted antenna mounted in fixed position on bottom.

FIG. 6 Wireless communication device with angled earpiece and inverted antenna.

FIG. 6A Side view of alternate wireless phone with "Z" shaped angled housing.

FIG. 7A Communication device with internal inverted antenna and angled earpiece.

FIG. 7B Communication device in FIG. 7A (side-view).

FIG. 8 Pivotal Inverted antenna mounted on side and bottom of wireless communication device.

Figure 9:
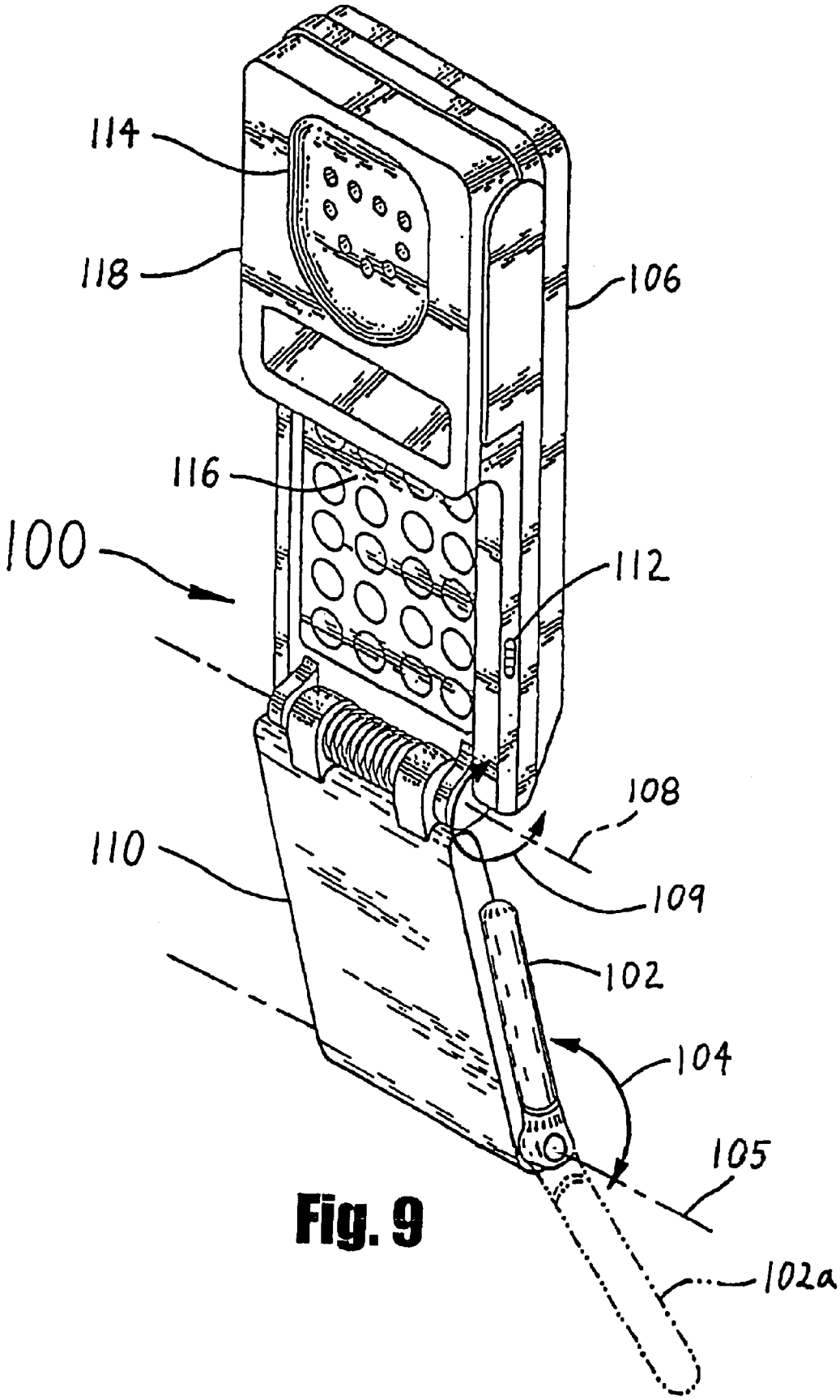

FIG. 9 Inverted antenna mounted on flip down door of wireless communication device.

FIG. 9A Side-view of earpiece and extension arm on communication device in FIG. 9.

Figure 10:
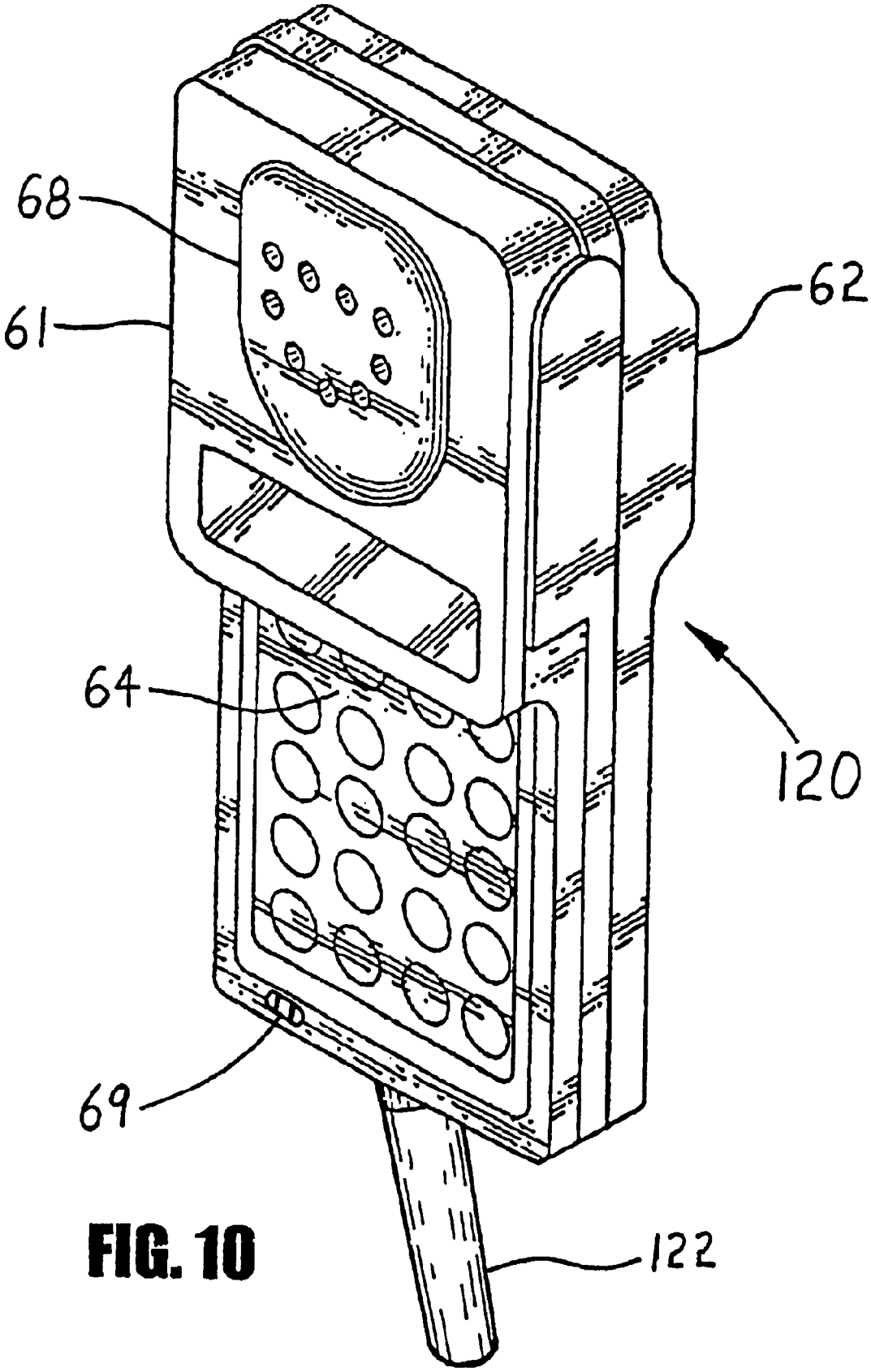

FIG. 10 Inverted antenna mounted on pivoting joint on bottom of wireless communication device.

Figure 11:
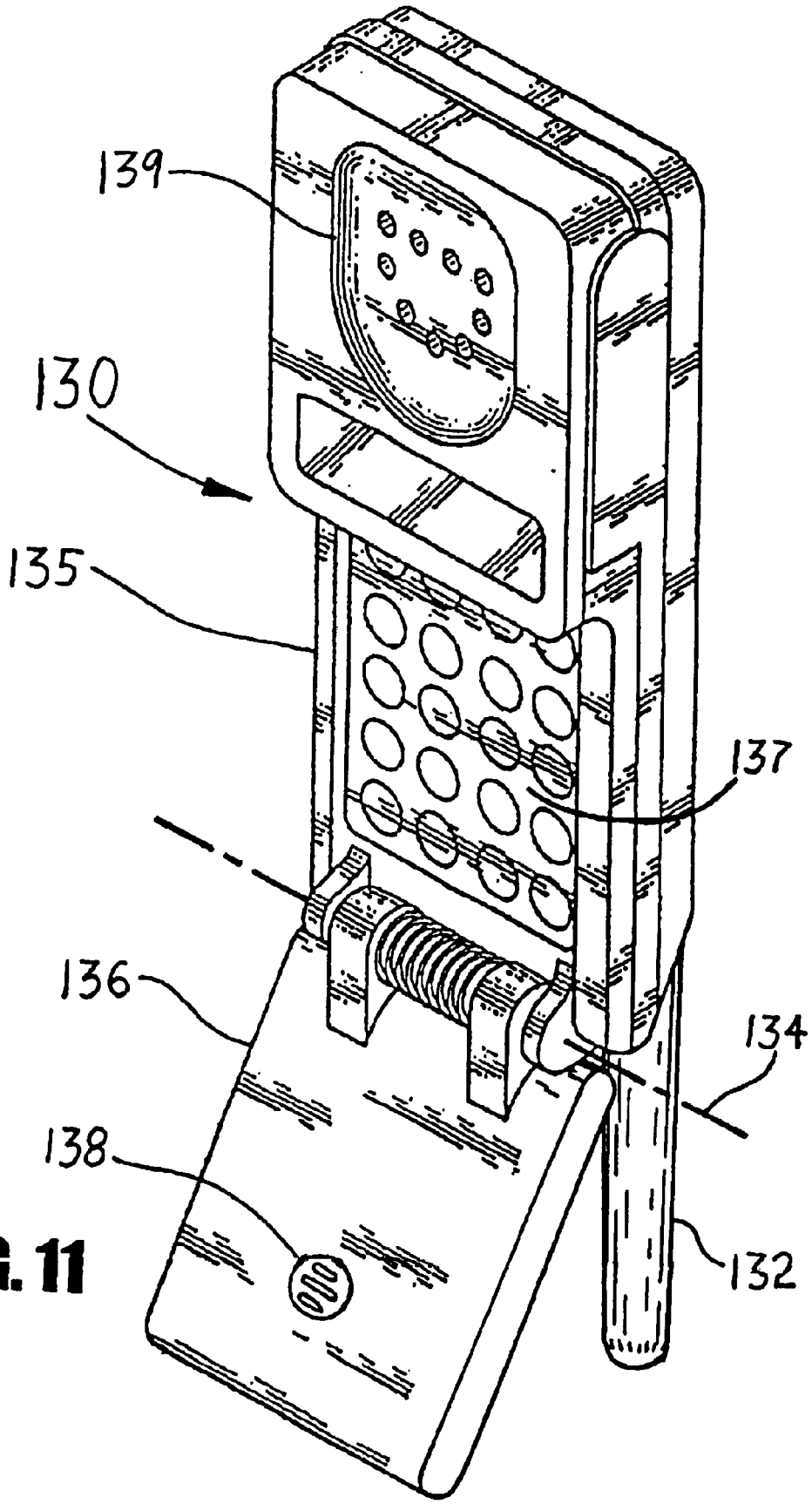

FIG. 11 Inverted antenna flip-down shielded to protect user.

FIG. 12A Preferred design—flip phone with Inverted antenna (perspective view).

Figure 12B:
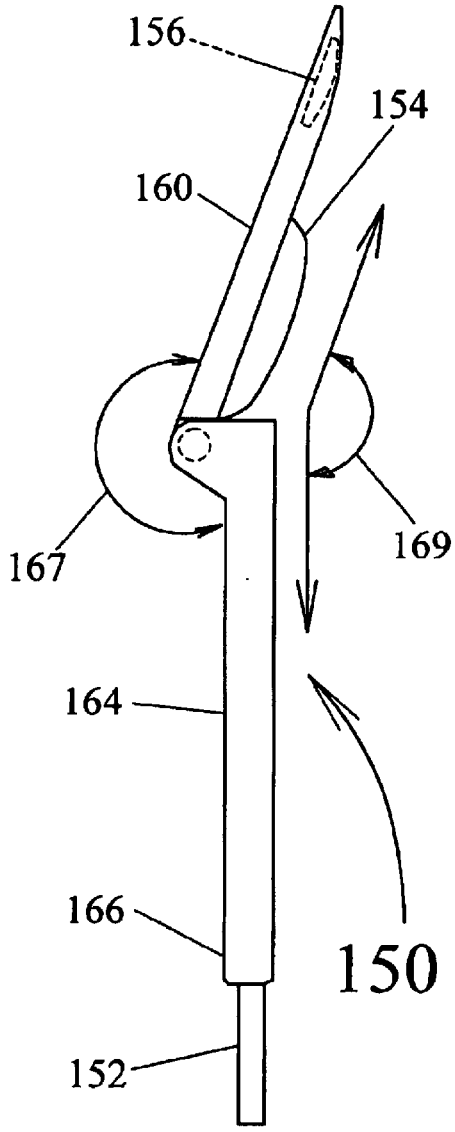

FIG. 12B Preferred design—flip phone with Inverted antenna in FIG. 12 (side-view).

The invention presented here solves one of the most talked about safety problems facing users of cellular phones and other high-power wireless personal communication devices. This problem is the close proximity of high-intensity electromagnetic radiation to the side of a user's head. Blocking or reflecting the radiation is not a desirable option because the signal should radiate in all directions for best reception. None of the manufactures want to be known as the manufacture with cellular phones that fade in an out as you use them. Thus, most manufactures have simply tried to move the antenna away from the user's head as much as possible while leaving the antenna at the top portion of the device. This has reduced radiation intensity slightly, but levels are still near the maximum allowed by law. The disclosed invention solves these problems by moving the antenna away from the user's head and placing it below the main housing of the wireless communication device. The bottom portion of the wireless device can be angled away from the user for optimal operation. This moves the radiation pattern away from the user's upper head area to several inches away from the user's brain, head, chin and neck. For a standard sized cellular phone this places the antenna (see FIGS. 4, 6, and 7A & B) about five inch from the user's face and several inches away from the user's neck and brain. In addition, the highest intensity electromagnetic field can be directed away from the user's head. By transmitting at approximately neck level, horizontal obstructions are minimized because of the lower cross-section of a user's chin and neck area. These cellular phone designs will allow higher transmitter power levels to be used safely because so much less of the radiation is actually absorbed by the user. Much greater power levels can be used and still remain well below the maximum allowable by law. Present cell phones, on the other hand, are just barely passing power absorption standards now. If new frequency bands (for higher data rates) are used, transmitters that are more powerful may be required. The disclosed cellular phone designs shown here make these high power transmitters practical by keeping radiation levels within government SAR standards.

The following embodiments of the invention are examples of possible ways of designing a phone with an angled earpiece and a bottom mounted antenna. All designs discussed here use standard transceiver circuits and antenna designs, however future antenna and transceiver designs can easily be substituted into the invention. A standard transceiver electronic circuit would comprise a user interface (keypad, display, voice recognition, and/or etc.), a transmitter circuit, a receiver circuit, a transmitting antenna, a receiving antenna (receiving and transmitting antenna may be the same antenna), a microphone coupled to the transmitter, and a speaker coupled to the receiver. The transmitting antenna can be mounted either internally or externally on any of the designs and may use separate antennas for the transmitting and receiving. Discussion of reduced radiation levels within this application will always be in reference to the transmitting antenna since it is where nearly all electromagnetic radiation is radiated from on a wireless communication device.

DETAILED DESCRIPTION

In FIG. 1 we see a Prior Art personal wireless communication device 30 being held by operator (user) 40. Such devices can come in many forms and provide many different functions. There are two main types of wireless devices: 1) site-to-site transceivers, and 2) cellular communication devices. Site-to-site transmissions would include such devices as walkie-talkies, digital personal communicators, cordless phones, etc. Cellular communications devices would include mobile communicators such as cellular phones (both analog and digital), satellite phones, and etc., which switch from one receiver to another as the user moves from one "cell" to the next. Throughout this application we will refer to all these devices using the terms "wireless communication devices", "personal communication devices", "communication devices", "cellular phones" or just "phones". The common factor with these wireless communication devices is that they are hand-held and placed near the user's ear during use. Notice in FIG. 1 that the user's head is only a small distance 41 from antenna 32 on communication device 30. For standard cellular phones, this distance is typically less than one-inch and can be difficult to increase because of the small size of the phone. Increasing the size of the phone is not a desirable option since people want a compact and lightweight phone. Holding the phone further from ones head does not work either because at even small distances from the user's ear, speaker sound quality drops dramatically. Plus, holding the phone away from ones ear for any length of time is a very unnatural way to hold a phone.

FIGS. 2A and 2B shows Prior Art communication device 50 (cellular phone). Cellular phone 50 can be a standard design that hides antenna 52 inside the upper portion of phone housing 58. For this phone design 50, antenna 52 can be mounted horizontally across the top inside of housing 58 and near the back surface of the phone, but may also be mounted vertically. Placing the antenna inside the housing allows the phone to fit in ones pocket easier and gives the phone a cleaner more ergonomic shape. As with most other prior art cellular phones, cellular phone 50 also mounts speaker outlet 56 near the top of housing 58 (near antenna 52), and a pickup microphone 54 near the bottom of housing 58. Antenna 52 can be placed near the back inside surface of the phone (see FIG. 2B) and radiates in all directions. In some prior art designs, the antenna would actually mount higher than shown and actually form the top surface of the phone housing 58. Antenna 52 may be any standard antenna design for transmitting a signal, including those for a particular mode type (CDMA, TDMA, PCS, GSM, digital, analog, combination transmitters, etc.). The plastic housing 58 attenuates very little of the radio signals emitted by antenna 52, and the antenna radiates at high-power into the side of the operator's head during use.

FIG. 3 shows an alternative communication device 60. In this design the body of the communication device is straight and antenna 66 is substantially in-line with the body of the device. With transmitting antenna 66 on the bottom of communication device 60, the antenna is a distance 42 from the user's face, which can be significantly greater than distance 41 for prior art device 30.

FIG. 4 shows an angled housing embodiment of the invention as personal communication device 70 (see FIG. 6 for more detail on communication device 70). The design incorporates antenna 76 on the bottom of communication device 70. The communication device can also be bent or angled near its mid-section to move the antenna even further away from the user's face. The result is that antenna 76, and emitted radiation, are moved a distance 43 away from the user, which can be significantly greater than distances 41 and 42 seen in FIGS. 1 and 3. One of the major uses for personal communication device today is for cellular phones. Cellular phones have particularly high radiation intensities near their small antennas. So even moving a couple inches away from the antenna can greatly reduces the radiation intensity. Also notice that communication device 70 has its highest signal intensity around the user's chin and hand. The chin and hand area are much less sensitive tissue compared to the brain, and do not appear to be greatly effected by the electromagnetic radiation given off by communication devices. Even so, with communication device 70, the user's hand and chin are actually much further away from antenna 76 than standard cellular phones place their antenna from the user's brain.

In FIG. 5 we see a perspective view of a communication device 60 seen used in FIG. 3. This device uses standard wireless communication electronics, but places antenna 66 and microphone 69 on the bottom of housing 61. Speaker outlet 68 can be placed near the top of housing 61 with control panel 64 and display 65 below it. Battery pack 62 powers the device. The natural curvature of a person's face near their chin means that antenna 66 extends away from the user more than if it were attached to the top of housing 61. If communication device 60 were a cellular phone, the user would experience much lower electromagnetic radiation levels in their head and brain than they would experience if they used a standard cellular phone (antenna placed at the top of phone).

FIG. 6 shows a perspective view of personal communication device 70 seen used in FIG. 4. In this design, communication device 70 can be using a cellular phone transceiver circuit, but could just as easily be any other wireless communication device. Cellular phone 70 uses standard electronics similar to those found in present day cellular phones, with a battery 75, a control pad 78, a display 79, a speaker earphone 71, microphone 73, and an antenna 76. Earphone 71 can be built into housing 72 and designed for use against a user's ear for listening. The earphone is also placed near the top portion of housing 72 to keep it as far away from antenna 76 as possible. This is because the earphone must be placed next to the user's ear (and head) during use. Antenna 76 can be placed near the bottom end of housing 72 to place it as far as possible from earphone 71. Control pad 78 and display 79 are placed between speaker 71 and antenna 76. With the present state of microphone technology, microphone 73 could be placed just about anywhere on cellular phone 70, and is commonly placed on the side of the housing. In this design, microphone 73 is shown near the bottom of control panel 78. Battery pack 75 snaps on the back of housing 72 and provides power to the cellular phone.

The design in FIG. 6 can incorporate: 1) an antenna mounted on the bottom of housing 72 instead of the top, and 2) an angled section in housing 72 so that the position of antenna 76 is further away from the user's face than if the housing was of an in-line design (see FIGS. 3 and 5). These changes can make a significant reduction in the radiation absorbed by a user compared to prior art. Angle change 74 causes housing body 72 to form an obtuse angle between the upper and lower portions of the phone (obtuse is defined as an angle between 90 and 180 degrees). Thus, angle change 74 is less than 90 degrees and allows a user to place earphone 71 flat against their ear while at the same time the position of antenna 76 is angled away from their face and head. The closer the bend occurs to the top of the housing the more of the housing is available to help extend the antenna away from the user (see FIG. 7B). The angling of the housing can take on many forms, with more than one bend being used to give the phone a pleasing look (see FIG. 6A). The housing can be a stretched "S" and "Z" shaped, such as "Z" shaped housing 77 in FIG. 6A with antenna 76 on the bottom or similar shapes with smoother bends in it. The phone in FIG. 6A is shown in a side view with housing 77 upright with the same battery pack 75 and transmitting antenna 76 as phone 70 in FIG. 6. These shapes can produce the angling of the lower portion of the housing away from the user even though the bottom of the housing may still be in-line (see FIG. 6A) or at another angle with respect to the top of the housing. Phone 70 in FIG. 6 shows antenna 76 in-line with the lower portion of housing 72, but can just as easily be mounted at a different angle than the lower housing. Similarly, once the bottom of the phone has been angled away from the user, the housing can be angled again while still keeping the bottom of the phone housing significantly away from the user's face and head. While the bend in housing 72 relies on antenna 76 being placed on the bottom of the cellular phone, the antenna does not rely on the bend (angle change 74) to reduce radiation levels. As seen in FIG. 5, even a straight housing design, with the antenna on the bottom significantly reduces, both total radiation absorbed by the user's brain, and peak intensity experienced by the user's brain, plus it reduces overall exposure to the user's head in general.

FIGS. 7A and 7B shows an alternative communication device 80, where an inverted antenna 82 can be mounted inside housing 88. The basic layout of the phone is the same as for prior art cellular phone 50 in FIGS. 2A and 2B, but with a transmitting antenna 82 placed in the bottom portion of the phone housing 88. Antenna 82 can be a directional gain transmitting antenna which primarily radiates electromagnetic signals in the direction of wavy lines 89 which represents the direction of maximum emitted energy intensity (minimum designed to be in the direction of user's head). At higher transmission frequencies, antenna size can decrease while still providing the same directional aspects of its output signal. A directional gain antenna usually has a weak signal in the opposite direction of the maximum signal strength. Generally, the maxima and minima are 180 degrees apart (point in opposite directions). Where the maxima is defined as the direction of strongest electromagnetic signal and the minima is the direction of weakest electromagnetic signal. Even smaller signal gains can reduce user absorbed radiation if the user is properly positioned away from the maximum signal output (maxima). Antenna 82 can be angled within the bottom portion of housing 88 so that the maximum radiation intensity from the antenna points away from the user while in use (speaker output 86 is pressed flat against the user's ear). This results in a electromagnetic radiation profile minimum in the direction of the user's face, and significantly reduces the radiation absorbed by the user's head and body. Speaker output 86 and microphone input 84 can be placed near the top and bottom of phone 80 respectfully as shown in FIGS. 7A and 7B. Cellular phone housing 88 can be angled with an angle change 74 (same numerical angle as seen in FIG. 6). Angle change 74 causes the upper and lower portions of housing 88 to form an obtuse angle with respect to each other. This allows speaker output 86 to be placed flat against the user's ear, while the majority of housing 88 angles away from the user's face. This in turn causes antenna 82 to be moved even further away from the user's head and face when being used (see FIG. 4). The angled nature of this phone design also can make it easier to be placed in ones pocket when traveling especially if a gentle bend is used to angle the bottom of the phone away from the user's face and/or head.

FIG. 8 shows another alternative communication device 90 with a storable antenna 94 that can rotate about axis 93 to a multitude of positions for use. Communication device 90 uses standard wireless communication circuitry to drive antenna 94. Speaker outlet 98 can be placed on the top portion of housing 97 so that antenna 94 extends as far below the speaker as possible during use. Battery pack 92 powers the phone for mobile operation. Control panel 96 can be used to enter commands which are displayed on display 99. During use, antenna 94 can be rotated to any position along its rotation path 95. Antenna 94 can operate in the shown stored position, however, rotating the antenna down away from housing 97 can improve reception and also move the antenna further away from the user's face. In the stored position shown in FIG. 8, antenna 94 can be partially shielded by recess 91 in housing 97. Alternatively, antenna 94 can be stored in a recess on the back of housing 97 and near the bottom and middle. Then when the antenna is in the recess, it would be shielded on both sides not just one, thus allowing both right and left handed user's to be shielded from radiation.

FIG. 9 shows another alternative communication device 100, with a pivotal antenna 102 mounted on a pivotal cover panel 110. This design shows that multiple pivot panels can be used to further increase the distance antenna 102 can be placed from speaker outlet 114 during use. The further the antenna is from the speaker (and thus the user's ear) the further antenna 102 can be from the user's head. Flip down panel 110 pivots along axis 108 with a pivot range of more than 180 degrees (see range of rotation 109), and can pivot from a closed position covering control panel 116 to many open positions that include a position in-line (180 degrees from closed position) with housing 118. When panel 110 is pivoted more than 180 degrees from the closed position, panel 110 is moved further away from the user's face along with antenna 102. FIG. 9 shows antenna 102 in the stored position and also in an alternate extended position 102*a*. Antenna 102 can be mounted on the end of panel 110 so that it can rotate about axis 105 through a pivot range 104. Notice that the position of antenna 102 with respect to the user is effected by both the orientation of antenna 102 around axis 105 and the position of panel 110 around axis 108. Thus, antenna 102 can be placed in the optimum position for reducing radiation absorbed by the user. Pivot axis 105 can easily be made to rotate over a larger angle than shown. Microphone 112 is placed on the side of housing 118 for picking-up the user's voice during use. Battery pack 106 powers the communication device for mobile use. By increasing the length of panel 110 the panel can cover the entire front face of housing 118, even very small cellular phone can extend its antenna a considerable distance away from the user (also see FIGS. 12A&B). To reduce the absorbed radiation the most, the user would rotate panel 110 approximately to the position shown in FIG. 9, so that antenna axis 105 is positioned as far as possible away from the user's head. This moves pivot axis 105 further away from the user. Antenna 102 can then be rotated even further away from the user to further reduce the radiation intensity experienced by the user's head. The attachment location of antenna 102 to panel 110 is not critical, though the antenna can be moved the furthest away from the user when attached near the bottom of panel 110 as shown.

FIG. 10 shows another alternative phone 120. This design shows a pivotal antenna 122 mounted on the same communication device housing as seen in FIG. 5. By allowing the user to pivot the antenna along two axis, one can potentially move the antenna further away from the user and/or change the direction of the antenna output for better transmission/reception. The antenna can also be fixed in a specific angled position to provide simpler operation and maximize antenna position. Such a pivotal antenna can be placed anywhere near the bottom of housing 61. Preferably, antenna 122 would be placed on the bottom far corner of housing 61, away from the user. However, since both right and left-handed people would use the phone, placement of the antenna in the center, as shown, is an example would probably be best.

FIG. 11 shows another alternative communication device 130 with a flip-down shield 136 to deflect and absorb radiation coming from antenna 132 away from the user from. While this would help protect the user, it could adversely effect reception and transmission of the communication device by absorbing signal. Shield 136 pivots down along axis 134 for use and then folds back up to cover control panel 137 when not in use. Microphone 138 is placed on the inside of shield 136 for better reception of the user's voice, but can just as easily be mounted on housing 135. Speaker outlet 139 is placed on the top portion of housing 135 so that the housing and antenna extend downward from the user's ear. This is so antenna 132 can be places as far away from the user as possible in used.

FIGS. 12A and 12B show presently preferred design for a personal wireless communication device. Flip phone 150 has two main sections, an upper housing portion 160 and a lower housing portion 164. Upper housing 160 comprises an elongated body with an sound outlet earpiece 158 molded into the housing and having openings to allow sound to exit from speaker 156 mounted behind the earpiece. For this design, battery 154 is mounted on the upper housing, but can just as easily be mounted to the lower housing. Upper housing 160 can also be designed for the user to easily hold. This allows the user to keep their hand and fingers away from antenna 152 while holding the phone naturally. Lower housing 164, in contrast, can be designed to not be easily gripped to encourage the user hold onto the upper housing and keep their hand away from antenna 152, and thus lowering electromagnetic radiation absorbed and also improving signal transmission. Lower housing 164 can contain the controls for the phone, including keypad 165. Microphone 166 can be mounted in the lower housing near the bottom to place it somewhat in front and to the side of the user's mouth when speaking. In alternative embodiments, microphone 166 can be located at other locations on the lower housing or on the upper housing. In the specific embodiment in FIGS. 12A and 12B, transmitting antenna 152 is mounted on the bottom portion of lower housing 164. This is done to keep the transmitting antenna as far away from sound outlet 158 as possible while being used. Mounting the antenna on the bottom can maximize the distance between the user's car and the transmitting antenna. In alternative embodiments, the antenna can be placed elsewhere on lower housing 164 and may include a pivoting antenna like antenna 102 seen in FIG. 8. Upper housing 160 and lower housing 164 can be connected near the middle, for example, by hinge attachment 162. Spring tension within hinge 162 can give it at least two stable positions: 1) an extended (open) position (shown in FIGS. 12A and 12B), and 2) a retracted (closed) position where upper housing 160 closes against lower housing 164. In the closed position keypad 165, display 163, and/or microphone 166 can be covered by the upper housing. Upper housing 160 rotates along the path shown by pivot path 167, and has at least 180 degrees of arc between the retracted and extended positions. Preferably, angle 167 is approximately 190 to 240 degrees. When open (extended), phone 150 forms an obtuse angle 169 between the upper and lower housing in such a way that the lower housing angles away from the user's face when earpiece 158 is placed flat against the user's ear. This results in the transmitting antenna being a significantly greater distance from the user's head and face than if the phone did not open passed the straight line position (180 degrees from closed position).

Operational Description

In FIGS. 3 through 12B the changes proposed for personal communications devices in this application do not significantly change the operating characteristics or size of the devices compared to industry standard phones. Moving the antenna to the bottom of the device changes very little about its operational use. The way battery charging lines and earphone wires are connected may need to be modified or moved for ergonomic reasons, but these are only cosmetic changes. Similarly, placing an angled section or bend in the housing of the communication device does not change its size significantly nor does it change the way a user would operate it from that of a standard communication device. In fact, the actual differences can be invisible to the user for phones with internally mounted antennas. The changes mostly effect where and how electromagnetic radiation from the transmitting antenna is absorbed by the user's head and body. By simply adding proper geometry to the device, the transmitting antenna can be moved further away from the user's head, and thus greatly reduce the radiation intensity to sensitive brain tissue. This can all be done without significantly changing the ergonomics of the communication device, which is essentially the same size, and has the same operating characteristics as the present art.

The operation of the phone designs shown in FIG. 9 and FIGS. 12A&B are slightly different that prior art phones and will be discussed below.

The operation of phone 100 seen in FIG. 9 can be similar to a flip-down cover style phone, but the addition of pivotal antenna 102 makes operation slightly different. In its stowed position, panel 110 can be folded to cover-up keypad 116, but could just as easily be designed to cover more or less of the phone's main housing 118. When phone 100 is used, panel 110 can be folded down into the position shown. At this point the user may operate the phone like any standard phone. However, the user may also rotate the antenna to place it even further away from themselves by pivoting it around axis 105 to a position such as position 102*a*. This effectively moves the antenna further away from both phone 100 and the user. The user then operates the phone normally.

Operation of phone 150 seen in FIGS. 12A&12B can be identical to the operation of a standard flip phone, and discussed here for clarity. Upper housing 160 is normally stored in the closed position with upper housing 160 and lower housing 164 folded together (upper housing folded down to cover keypad 165 on lower housing 164). To operate, upper housing 160 is lifted off of lower housing 164 and rotated through angle 167 to the position seen in FIGS. 12A and 12B. Spring tension within hinge 162 holds upper housing 160 in this backward angled position while in use. Phone 150 may also have a stable position in a substantially in-line (straight configuration) as well as other useful angles depending on the user's needs Once keypad 165 is exposed, the user then dials a phone number and rests sound outlet 158 against their ear to listen and talk. The obtuse angle 169 between the upper and lower housing causes transmitting antenna 152 to angle away from the user's face. Thus, radiation exposure can be reduced by the extra distance between the user and the transmitting antenna. Radiation exposure can also be reduced by positioning the transmitting antenna so that the user's head is substantially placed within the minimum portion the antenna's radiation pattern (lowest radiation direction is often directly behind the maximum output direction for the antenna. For the specific embodiment of phone 150 this would mean the lowest radiation levels would be longitudinally along antenna 152 and lower housing 164). Upper housing 160 can be designed to have the majority of the volume of the phone so that the user can easily grip upper housing 160 to talk. With the user griping mainly the upper housing, the user's hand and fingers are kept away from the lower housing and transmitting antenna 152. This reduces the radiation levels experienced by their hand as well as their head. In an additional embodiment, a majority of the mass of phone 150 can be placed in the upper portion of the phone will help make the phone feel more balanced when gripped.

Ramifications, and Scope

Although the above description of the invention contains many specifications, these should not be viewed as limiting the scope of the invention. Instead, the above description should be considered illustrations of some of the presently preferred embodiments of this invention. For example, there are many ways to attach an antenna to the communications device housing, and the exact attachment position is non-critical to the operation of the invention as long as the antenna is sufficiently far away from the earpiece on the device. Similarly, many types of antenna designs could be used with the disclosed invention since significant radiation exposure reduction is a result of proper geometric placement of the antenna alone. The use of directional antenna's can provide an even greater reduction in radiation exposure. Also, the use of a user interface (keypad and/or display) is not vital to the proper operation of the inverted antenna and the keypad may easily be replaced by voice-activated systems. Also, the flip-phone seen in FIGS. 12A & B may have its components rearranged. While speaker earpiece 158 and antenna 152 need to remain in the upper and lower housing, respectfully, other components like the battery, display, microphone, and user interface may be easily moved to the desired portion of the phone. For example, one may want a phone design to have a longer lower portion and just a smaller flip-up speaker that angles backward. This allows the lower portion with the antenna to angle the maximum distance from the user's face (see FIGS. 7A & B for a non-pivoting example of this). Also notice that while the designs here show a rather abrupt angle change between the upper and lower portions of the phones, this need not be the case, and gentle arcing bends may be used between the speaker output and the transmitting antenna to provide the angled body function. Finally, many styles and designs for retractable/extendable antennas exist in the market place. The invention presented here can be easily adapted to accept any of these retractable/extendable (sliding or rotating) antennas for placement near the bottom of the phone housing where the antenna may rotate or slide into the housing for storage.

Thus, the scope of this invention should not be limited to the above examples, but should be determined from the following claims.

We claim:

1. A wireless communication device, comprising:

a) a housing b) a microphone;

c) a speaker earpiece;

d) a user interface mounted in an upright orientation on the communication device;

e) a transmitting antenna;

f) wherein, said housing comprising an upper housing portion on top and a lower housing portion on the bottom;

g) wherein, said speaker earpiece is mounted in said upper housing portion and defines a resting surface for resting against a user's ear to communicate sound to the user's ear;

h) wherein, said transmitting antenna for transmitting electromagnetic signals mounted in said lower housing portion;

i) wherein, said microphone is positioned on the communication device to detect audible sounds from the user;

j) wherein, during use, the communication device positions said transmitting antenna away from the user's ear because of the distance between said speaker earpiece and said transmitting antenna, and k) said housing defines an obtuse angle between the ton of said upper housing portion and the bottom of said lower housing portion such that the bottom of said housing is positioned substantially away from both the plane defined by said resting surface and the user's face during use, whereby the position of said transmitting antenna is angled away from the user's head and face during use.

2. The wireless communication device in claim 1, wherein;

said transmitting antenna is mounted substantially inside said lower housing portion of said housing.

3. The wireless communication device in claim 1, further including;

a shield adapted for reducing electromagnetic radiation emitted by the antenna in the direction of the user's head and body while in use, whereby radiation levels experienced by the user are further reduced.

4. The wireless communication device in claim 1, wherein;

said transmitting antenna is a directional gain antenna and oriented to radiate its minimum intensity in the general direction of the user's head for reducing electromagnetic radiation absorbed by the user.

5. The wireless communication device in claim 1, wherein;

said obtuse angle is defined by a slowly curving section of the housing between the upper and lower portion of the housing.

6. The wireless communication device in claim 1, wherein;

said transmitting antenna is mounted substantially to the bottom of the lower housing portion such that the antenna extends below the housing.

7. The wireless communication device in claim 1, wherein;

said upper housing portion pivotally connected to said lower housing portion to allow pivoting action between a closed position where said upper and lower portions are folded together, and an open position where said obtuse angle is formed between the top and bottom of the housing.

8. The wireless communication device in claim 7, wherein;

said upper housing portion contains more volume than the lower housing portion to encourage the user to grip the communication device by said upper housing portion to reduce radiation absorbed by the user's hand and fingers.

9. The wireless communication device in claim 7, wherein;

said upper housing portion contains more mass than the lower housing portion to encourage the user to grip the communication device by said upper housing portion to reduce radiation absorbed by the user's hand and fingers.

10. The wireless communication device in claim 7, wherein;

said antenna for transmitting is defined by a directional gain antenna for reducing electromagnetic radiation emitted by the antenna in the direction of the user's head and body while in use.

11. The wireless communication device in claim 1, wherein;

said upper portion is designed to be easily gripped by the user, and said lower housing is designed to be less easily gripped, whereby the user preferably holds the communication device by the upper portion of the housing.

12. A wireless communication device designed to minimize a user's exposure to high-intensity electromagnetic radiation, comprising:

a) a transceiver circuit comprising a transmitter, a receiver, a speaker, a battery, a user interface, a display, and an antenna;

b) a housing for holding said transceiver circuit and having a upper portion and a lower portion;

c) said antenna mounted substantially to said lower portion of the housing for transmitting electromagnetic signals;

d) said speaker mounted substantially to said upper portion of the housing to communicate sound to a user's ear;

e) said upper portion defining an earpiece designed for placement against the user's ear for hearing said speaker;

f) said housing defines an obtuse angled portion between said upper and lower portions so that when said earpiece is placed flat against said user's ear the lower portion of said housing is angled substantially further away from the user's face than if the housing were substantially straight, whereby the electromagnetic radiation intensity experienced by the user is reduced by keeping the antenna away from the user's face.

13. The wireless communication device in claim 12, wherein;

said antenna is defined by a directional gain antenna that reduces electromagnetic radiation emitted by the antenna in the direction of the user's head and body while in use.

14. The wireless personal communication device in claim 12, wherein;

said transceiver circuit consists of a site-to-site transceivers circuit such as for cordless phones, digital communicators, and walkie-talkies.

15. The wireless personal communication device in claim 12, wherein;

said upper portion is designed for better gripping by the user than said lower portion, whereby the user may keep their hand and fingers away from said antenna.

16. The wireless communication device in claim 12, wherein;

said antenna for transmitting is designed to have a minimum in its radiation pattern directed substantially toward the user, whereby radiation absorbed by the user is further reduced.

17. The wireless communication device in claim 12, wherein;

said obtuse angled portion is defined by a pivotal axis which allows the upper and lower portions of the housing to pivot from a closed position where said upper and lower portions are pivoted together and an open position where said obtuse angle is formed with said housing.

18. The wireless communication device in claim 17, wherein;

said upper portion is designed to be easily gripped and held by the user, whereby the user absorbs less radiation by keeping the user's hand and fingers away from the antenna by encouraging the user to grip the communication device by the upper portion.

* * * * *

UNITED STATES PATENT AND TRADEMARK OFFICE

CERTIFICATE OF CORRECTION

PATENT NO. : 6,741,215 B2
APPLICATION NO. : 10/207691
DATED : May 25, 2004
INVENTOR(S) : Jerry Allen Grant, Gary Dean Ragner and James Garfield Geesey It is certified that error appears in the above-identified patent and that said Letters Patent is hereby corrected as shown below:

claim 1, column 12, line 14 should be corrected to read k) said housing defines an obtuse angle between the top of Signed and Sealed this Twenty-second Day of July, 2008

JON W. DUDAS
*Director of the United States Patent and Trademark Office*